US008948669B2

(12) United States Patent
Ono et al.

(10) Patent No.: US 8,948,669 B2
(45) Date of Patent: Feb. 3, 2015

(54) TRANSFER DEVICE AND IMAGE FORMING APPARATUS

(75) Inventors: Masato Ono, Kanagawa (JP); Haruyuki Namba, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 187 days.

(21) Appl. No.: 13/599,596

(22) Filed: Aug. 30, 2012

(65) Prior Publication Data

US 2013/0243462 A1 Sep. 19, 2013

(30) Foreign Application Priority Data

Mar. 15, 2012 (JP) ..... 2012-059300

(51) Int. Cl.
*G03G 15/20* (2006.01)
*G03G 15/16* (2006.01)

(52) U.S. Cl.
CPC ..... *G03G 15/1685* (2013.01); *G03G 15/1675* (2013.01)
USPC ..... 399/313; 399/314

(58) Field of Classification Search
CPC ..... G03G 15/1675; G03G 15/1685; G03G 2215/1614
USPC ..... 399/313, 314
See application file for complete search history.

(56) References Cited

U.S. PATENT DOCUMENTS

| | | | | |
|---|---|---|---|---|
| 6,542,703 | B1 * | 4/2003 | Jung | 399/44 |
| 7,390,562 | B2 * | 6/2008 | Onuki et al. | 428/317.9 |
| 2003/0185581 | A1 * | 10/2003 | Hisada | 399/45 |
| 2004/0086289 | A1 * | 5/2004 | Deguchi | 399/45 |
| 2004/0126153 | A1 * | 7/2004 | Koga et al. | 399/307 |
| 2004/0126156 | A1 * | 7/2004 | Stelter et al. | 399/313 |
| 2004/0156653 | A1 * | 8/2004 | Takehara | 399/167 |
| 2009/0154964 | A1 * | 6/2009 | Tsuruya | 399/308 |
| 2010/0129104 | A1 * | 5/2010 | Ogata et al. | 399/66 |

FOREIGN PATENT DOCUMENTS

| | | |
|---|---|---|
| JP | 2006-259173 A | 9/2006 |
| JP | 2006-259366 A | 9/2006 |

* cited by examiner

*Primary Examiner* — Benjamin Schmitt
(74) *Attorney, Agent, or Firm* — Sughrue Mion, PLLC

(57) ABSTRACT

A transfer device includes a transfer roller that has a characteristic in which an electrical resistance is changed in accordance with a rotation speed, contacts a transferred body that moves in synchronization with movement of an image holding body holding a toner image, and transfers the toner image held by the image holding body on the transferred body by applying a transfer voltage to the transferred body; and a regulator that regulates the rotation speed of the transfer roller independently from the movement of the image holding body and the transferred body.

6 Claims, 8 Drawing Sheets

FIG. 8

| | | FIRST TRANSFER UNIT 33 | | | | FIRST TRANSFER UNIT 43 (MODIFICATION) | | | | FIRST TRANSFER UNIT 53 (COMPARATIVE EXAMPLE 1) | | | | FIRST TRANSFER UNIT 63 (COMPARATIVE EXAMPLE 2) | | | |
|---|---|---|---|---|---|---|---|---|---|---|---|---|---|---|---|---|---|
| | | EARLY STAGE | | AFTER LAPSE OF LONG TIME | | EARLY STAGE | | AFTER LAPSE OF LONG TIME | | EARLY STAGE | | AFTER LAPSE OF LONG TIME | | EARLY STAGE | | AFTER LAPSE OF LONG TIME | |
| | | LL | HH | LL | HH | LL | HH | LL | HH | LL | HH | LL | HH | LL | HH | LL | HH |
| TRANSFER VOLTAGE | (kV) | 2.5 | 2.5 | 2.5 | 2.5 | 2.5 | 2.5 | 6.0 | 2.5 | 3.2 | 0.6 | 12 | 0.6 | 5.0 | 0.1 | 20 | 0.1 |
| ROTATION SPEED | (m/s) | 2.5 | 0.0 | 6.5 | 0.0 | 2.5 | 0.0 | 2.5 | 0.0 | 0.4 | 0.4 | 0.4 | 0.4 | 0.4 | 0.4 | 0.4 | 0.4 |
| ELECTRICAL RESISTANCE | (LogΩ) | 7.5 | 7.5 | 7.5 | 7.5 | 7.5 | 7.5 | 8.1 | 7.5 | 7.8 | 7.1 | 8.4 | 7.1 | 8.0 | 6.0 | 8.6 | 6.5 |
| IMAGE QUALITY | | A | A | A | A | A | A | B | A | B | C | D | C | B | D | D | D |

TRANSFER DEVICE AND IMAGE FORMING APPARATUS

CROSS-REFERENCE TO RELATED APPLICATIONS

This application is based on and claims priority under 35 USC 119 from Japanese Patent Application No. 2012-059300 filed Mar. 15, 2012.

BACKGROUND

The present invention relates to a transfer device and an image forming apparatus.

SUMMARY

According to an aspect of the invention, there is provided a transfer device including a transfer roller that has a characteristic in which an electrical resistance is changed in accordance with a rotation speed, contacts a transferred body that moves in synchronization with movement of an image holding body holding a toner image, and transfers the toner image held by the image holding body on the transferred body by applying a transfer voltage to the transferred body; and a regulator that regulates the rotation speed of the transfer roller independently from the movement of the image holding body and the transferred body.

BRIEF DESCRIPTION OF THE DRAWINGS

An exemplary embodiment of the present invention will be described in detail based on the following figures, wherein:

FIG. 8 illustrates a table showing image qualities of images, and transfer voltages, rotation speeds, and electrical resistances of first transfer rollers, when transfer devices respectively including the first transfer unit according to the exemplary embodiment, the first transfer unit according to the modification, the first transfer unit according to the first comparative example are used, and the first transfer unit according to the second comparative example, and when images are formed under a low-temperature low-humidity (LL) condition and a high-temperature high-humidity (HH) condition.

DETAILED DESCRIPTION

A transfer device and an image forming apparatus according to an exemplary embodiment of the present invention are described below with reference to the accompanying drawings.

General Configuration

Figure 1:
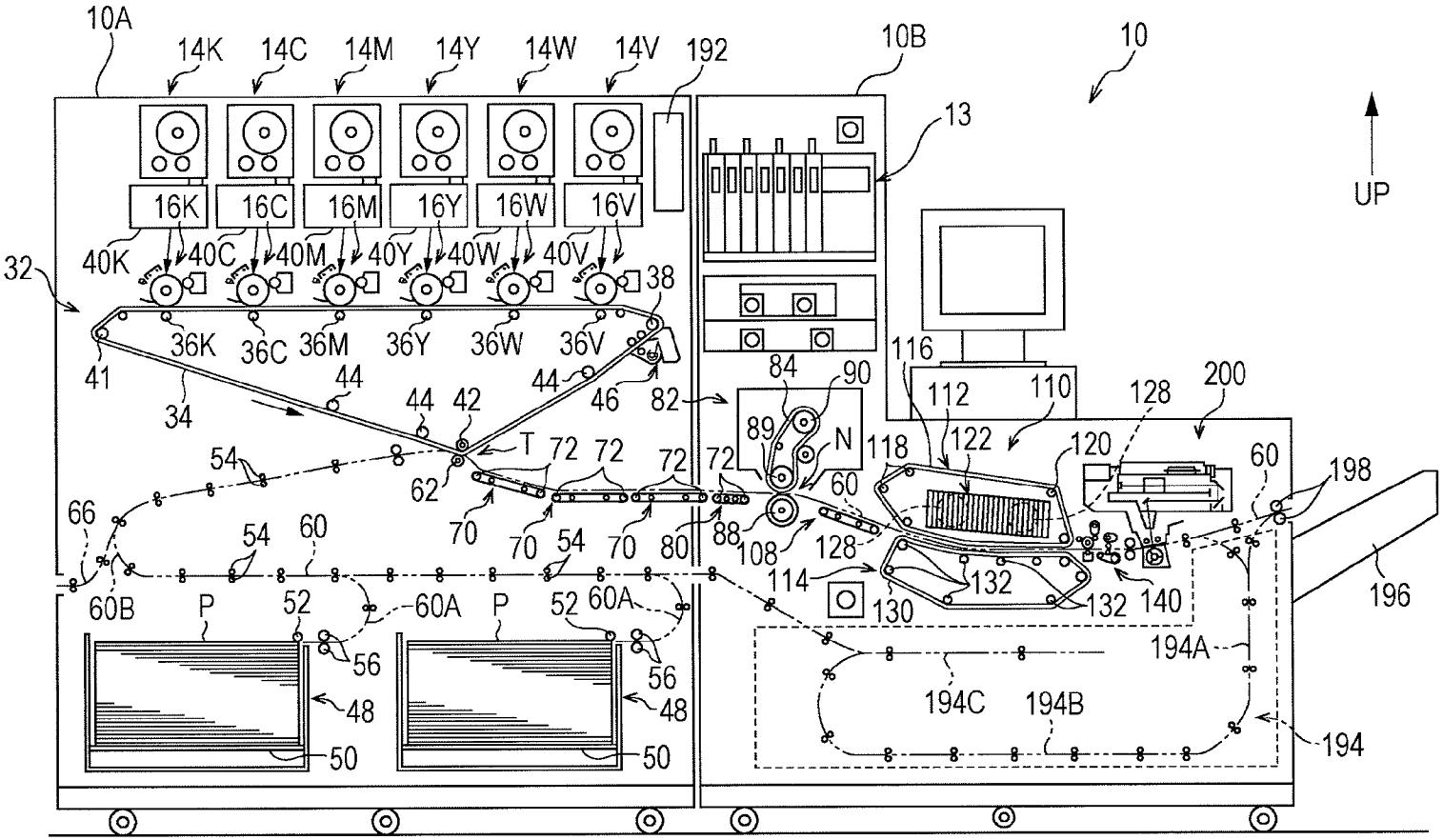
FIG. 1 illustrates a configuration of an image forming apparatus according to an exemplary embodiment of the present invention.

An image forming apparatus 10 according to this exemplary embodiment forms a full-color image or a monochrome image. As shown in FIG. 1, the image forming apparatus 10 includes a first housing 10A housing a first processing unit that forms a minus (−) section in the horizontal direction (at the left side in FIG. 1), and a second housing 10B connected with the first housing 10A in a dividable manner and housing a second processing unit that forms a plus (+) section in the horizontal direction (at the right side in FIG. 1).

An image signal processor 13 is provided in an upper portion of the second housing 10B. The image signal processor 13 performs image processing for image data transmitted from an external device such as a computer.

Toner cartridges 14V, 14W, 14Y, 14M, 14C, and 14K are provided in an upper portion of the first housing 10A along the horizontal direction in a replaceable manner. The toner cartridges 14V, 14W, 14Y, 14M, 14C, and 14K respectively house toners of a first special color (V), a second special color (W), yellow (Y), magenta (M), cyan (C), and black (K).

The first special color and the second special color are properly selected from colors (including a transparent color) except the yellow, magenta, cyan, and black. In the following description, if the first special color (V), second special color (W), yellow (Y), magenta (M), cyan (C), and black (K) are discriminated from each other, one of alphabetic characters of V, W, Y, M, C, and K is added to the numerical reference sign. In contrast, if the first special color (V), second special color (W), yellow (Y), magenta (M), cyan (C), and black (K) are not discriminated from each other, the alphabetic characters of V, W, Y, M, C, and K are omitted.

Further, six image forming units 16 corresponding to the toners of the respective colors are provided below the toner cartridges 14 along the horizontal direction, to respectively correspond to the toner cartridges 14.

Exposure devices 40 are provided respectively for the image forming units 16. Each exposure device 40 receives image data with the image processing performed by the image signal processor 13 from the image signal processor 13, modulates a light beam L in accordance with the image data, and radiates a corresponding photoconductor drum 18 with the light beam L (see FIG. 2).

Figure 2:
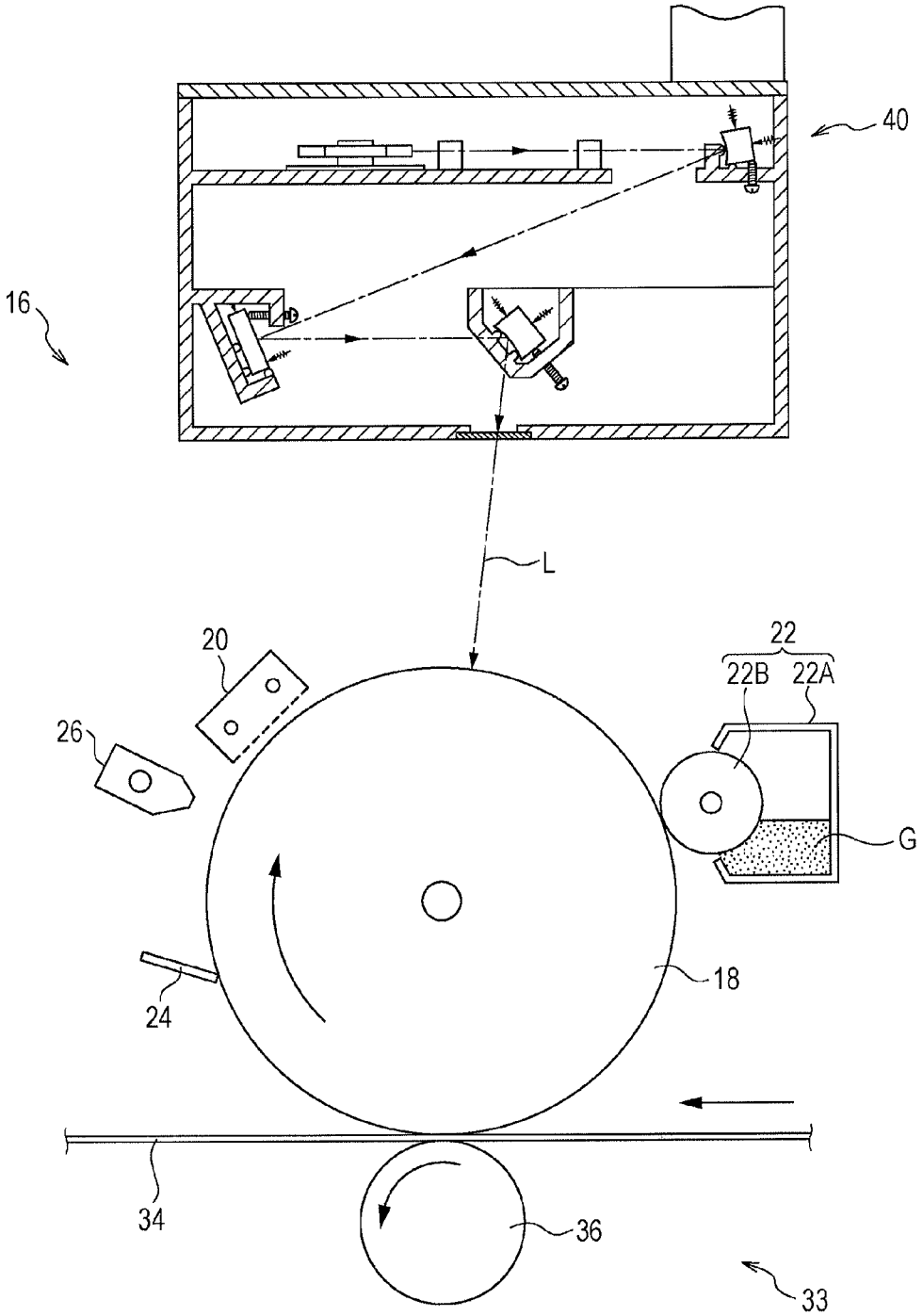
FIG. 2 illustrates a configuration of an image forming unit in FIG. 1.

As shown in FIG. 2, each image forming unit 16 includes the photoconductor drum 18 being an example of an image holding body that is rotationally driven in a direction (clockwise in FIG. 2). When each exposure device 40 radiates the corresponding photoconductor drum 18 with the light beam L, an electrostatic latent image is formed on the photoconductor drum 18.

Provided around each photoconductor drum 18 are a scorotron charging unit 20 of corona discharge type (non-contact charge type) that electrically charges the photoconductor drum 18, a developing device 22 that develops the electrostatic latent image formed on the photoconductor drum 18 by the exposure device 40 with a developer, a blade 24 being a removing member that removes the developer remaining on the photoconductor drum 18 after transferring, and a static-charge removing device 26 that radiates the photoconductor drum 18 with light after transferring and removes static charge from the photoconductor drum 18.

The scorotron charging unit 20, the developing device 22, the blade 24, and the static-charge removing device 26 face the surface of the photoconductor drum 18 and are arranged in that order from the upstream side to the downstream side in a rotation direction of the photoconductor drum 18.

The developing device 22 includes a developer housing member 22A that houses a developer G containing a toner, and a development roller 22B that supplies the developer G housed in the developer housing member 22A to the photoconductor drum 18. The developer housing member 22A is connected with the toner cartridge 14 (see FIG. 1) through a toner supply path (not shown), so that the toner is supplied to the developer housing member 22A from the toner cartridge 14.

As shown in FIG. 1, a transfer device 32 is provided below the image forming units 16. The transfer device 32 includes a transfer belt 34 being an example of a transferred body that contacts the photoconductor drums 18, and first transfer rollers 36 being examples of transfer rollers that transfer toner images formed on the photoconductor drums 18 onto the transfer belt 34 in a superposed manner.

The transfer belt 34 has a ring shape. The transfer belt 34 is wound around a driving roller 38 that is driven by a motor (not shown), a tension application roller 41 that applies tension to the transfer belt 34, a facing roller 42 that faces a second transfer roller 62 (described later), and plural rollers 44. The transfer belt 34 moves in a circulating manner in a direction (counterclockwise in FIG. 1).

The first transfer rollers 36 respectively face the photoconductor drums 18 of the corresponding image forming units 16 with the transfer belt 34 interposed therebetween. A power feed unit (not shown) applies a transfer voltage with a reverse polarity being reverse to a toner polarity, to each first transfer roller 36 (in other words, each first transfer roller 36 applies the transfer voltage with the reverse polarity being reverse to the toner polarity, to the transfer belt 34). Accordingly, the toner images formed on the photoconductor drums 18 are transferred on the transfer belt 34. The power feed unit determines the transfer voltage so that transfer current that flows from each first transfer roller 36 to the corresponding photoconductor drum 18 becomes constant (constant current control). The detailed configuration of a first transfer unit 33 of the transfer device 32 is described later.

A cleaning device 46 that cleans the outer peripheral surface of the transfer belt 34 is provided near the driving roller 38.

Two recording medium housing portions 48 are provided below the transfer device 32 along the horizontal direction. The recording medium housing portions 48 house recording media P such as paper.

Each recording medium housing portion 48 may be freely pulled out from the first housing 10A. A sending roller 52 is provided above a portion at the minus (−) side (the right side in FIG. 1) of each recording medium housing portion 48. The sending roller 52 sends a recording medium P from the recording medium housing portion 48 to a transport path 60.

A bottom plate 50 is provided in each recording medium housing portion 48. Recording media P are placed on the bottom plate 50. The bottom plate 50 is lowered in response to an instruction of a controller (not shown) when the recording medium housing portion 48 is pulled out from the first housing 10A. Since the bottom plate 50 is lowered, a space is formed in the recording medium housing portion 48. A user supplies recording media P to the space.

When the recording medium housing portion 48 pulled out from the first housing 10A is mounted in the first housing 10A, the bottom plate 50 is raised in response to an instruction of the controller. Since the bottom plate 50 is raised, the top of the recording media P placed on the bottom plate 50 comes into contact with the sending roller 52.

A separation roller 56 is provided downstream of the sending roller 52 in a recording-medium transport direction (hereinafter, occasionally merely referred to as "downstream side"). The separation roller 56 separate recording media P sent in a stacked manner from the recording medium housing portion 48, one by one. Plural rollers 54 that transport the recording medium P to the downstream side in the transport direction is provided downstream of the separation roller 56.

The transport path 60 is provided between the recording medium housing portion 48 and the transfer device 32. The transport path 60 transports the recording medium P sent from the recording medium housing portion 48 so that the recording medium P is turned to the left side in FIG. 1 at a first turn portion 60A, and further extends to a transfer position T between the second transfer roller 62 and the facing roller 42 so that the recording medium P is turned to the right side in FIG. 1 at a second turn portion 60B.

A power feed unit (not shown) applies a transfer voltage with a reversed polarity being reverse to the toner polarity, to the second transfer roller 62. Accordingly, the toner images of the respective colors transferred in a superposed manner on the transfer belt 34 are second-transferred on the recording medium P transported along the transport path 60 by the second transfer roller 62.

An auxiliary path 66 extends from a side surface of the first housing 10A and merges with the second turn portion 60B of the transport path 60. A recording medium P, which is sent from another recording medium housing portion (not shown) being adjacent to the first housing 10A, passes through the auxiliary path 66 and enters the transport path 60.

Plural transport belts 70 are provided in the first housing 10A at the downstream side of the transfer position T. The transport belts 70 transport the recording medium P with the toner images transferred thereon to the second housing 10B. A transport belt 80 is provided in the second housing 10B. The transport belt 80 transports the recording medium P transported by the transport belts 70, to the downstream side.

Each of the plural transport belts 70 and the transport belt 80 has a ring shape, and is wound around a pair of rollers 72. The pair of rollers 72 are arranged at the upstream side and the downstream side in the transport direction of the recording medium P. One of the rollers 72 is rotationally driven and hence the transport belt 70 (or the transport belt 80) is moved in a circulating manner in a direction (clockwise in FIG. 1). A suction device (not shown) that sucks the recording medium P is provided inside each of the transport belts 70 and the transport belt 80. Each of the transport belts 70 and the transport belt 80 transports the recording medium P while the recording medium P is sucked to the surface of the transport belt.

A fixing unit 82 is provided downstream of the transport belt 80. The fixing unit 82 fixes the toner images transferred on the surface of the recording medium P to the recording medium P with heat and pressure.

The fixing unit 82 includes a fixing belt 84 and a pressure roller 88 arranged to contact the fixing belt 84 from the lower side. A fixing part N is formed between the fixing belt 84 and the pressure roller 88. At the fixing part N, the recording medium P is pressed and heated, so that the toner images are fixed to the recording medium P.

The fixing belt 84 has a ring shape, and is wound around a driving roller 89 and a driven roller 90. The driving roller 89 faces the pressure roller 88 from the upper side. The driven roller 90 is arranged at the upper side of the driving roller 89.

The driving roller 89 and the driven roller 90 respectively have heaters such as halogen heaters. Accordingly, the fixing belt 84 is heated.

A transport belt 108 is provided downstream of the fixing unit 82. The transport belt 108 transports the recording medium P sent out from the fixing unit 82 to the downstream side. The transport belt 108 is formed like the transport belt 70.

A cooling unit 110 is provided downstream of the transport belt 108. The cooling unit 110 cools the recording medium P, which is heated by the fixing unit 82.

The cooling unit 110 includes an absorption device 112 that absorbs the heat of the recording medium P, and a press device 114 that presses the recording medium P to the absorption device 112. The absorption device 112 is arranged at a first side (the upper side in FIG. 1) and the press device 114 is arranged at a second side (the lower side in FIG. 1) with respect to the transport path 60.

The absorption device 112 includes a ring-shaped absorption belt 116 that contacts the recording medium P and absorbs the heat of the recording medium P. The absorption belt 116 is wound around a driving roller 120 and plural rollers 118. The driving roller 120 transmits a driving force to the absorption belt 116.

A heat sink 122 is provided at the inner periphery side of the absorption belt 116. The heat sink 122 is formed of an aluminum material that surface-contacts the absorption belt 116 and radiates the heat absorbed by the absorption belt 116.

Further, a fan 128 is arranged at the back side of the second housing 10B (the deep side of the paper face of FIG. 1). The fan 128 removes the heat from the heat sink 122 and exhausts the hot air to the outside.

The press device 114 that presses the recording medium P to the absorption device 112 includes a ring-shape press belt 130 that transports the recording medium P while pressing the recording medium P to the absorption belt 116. The press belt 130 is wound around plural rollers 132.

A straightening device 140 is provided downstream of the cooling unit 110. The straightening device 140 transports the recording medium P in a pinched manner and straightens a curve (a curl) of the recording medium P.

An in-line sensor 200 is provided downstream of the straightening device 140. The in-line sensor 200 detects a toner-density defect, an image defect, and an image-position defect of the toner images fixed to the recording medium P, and the position and shape of the recording medium P.

An output roller 198 is provided downstream of the in-line sensor 200. The output roller 198 outputs the recording medium P with an image formed on one surface thereof to an output portion 196 that is attached to a side surface of the second housing 10B.

In contrast, if images are formed on both surfaces, the recording medium P sent out from the in-line sensor 200 is transported to a reverse path 194 that is provided downstream of the in-line sensor 200.

The reverse path 194 includes a branch path 194A that is branched from the transport path 60, a paper transport path 194B that transports the recording medium P transported along the branch path 194A toward the first housing 10A, and a reverse path 194C that turns the recording medium P transported along the paper transport path 194B in a reverse direction so as to transport the recording medium P in a switch-back manner and to reverse the front side and the back side of the recording medium P.

With this configuration, the recording medium P that is transported in a switch-back manner at the reverse path 194C is transported to the first housing 10A, enters the transport path 60 provided above the recording medium housing portions 48, and is sent again to the transfer position T.

Next, an image forming process of the image forming apparatus 10 is described.

Image data with the image processing performed by the image signal processor 13 is sent to the exposure devices 40. The exposure devices 40 emit light beams L in accordance with the image data, expose the photoconductor drums 18, which are charged by the scorotron charging units 20, to the light beams L, and hence form electrostatic latent images.

As shown in FIG. 2, the electrostatic latent images formed on the photoconductor drums 18 are developed by the developing devices 22, and toner images of the respective colors including the first special color (V), second special color (W), yellow (Y), magenta (M), cyan (C), and black (K) are formed.

As shown in FIG. 1, the toner images of the respective colors formed on the photoconductor drums 18 of the image forming units 16V, 16W, 16Y, 16M, 16C, and 16K are successively transferred in a superposed manner on the transfer belt 34 by the six first transfer rollers 36V, 36W, 36Y, 36M, 36C, and 36K.

The toner images of the respective colors transferred in a superposed manner on the transfer belt 34 are second-transferred by the second transfer roller 62, on a recording medium P that is transported from the recording medium housing portion 48. The recording medium P with the toner images transferred thereon is transported by the transport belts 70 to the fixing unit 82 provided in the second housing 10B.

The toner images of the respective colors on the recording medium P are heated and pressed by the fixing unit 82, and hence are fixed to the recording medium P. Further, the recording medium P with the toner images fixed thereto passes through the cooling unit 110 and is cooled. Then, the recording medium P is sent to the straightening device 140, and a curve generated at the recording medium P is straightened.

The recording medium P with the curve straightened is subjected to detection of an image defect etc. by the in-line sensor 200. Then, the recording medium P is output to the output portion 196 by the output roller 198.

In contrast, if an image is formed on a non-image surface not having an image formed thereon (in case of duplex printing), after the recording medium P passes through the in-line sensor 200, the recording medium P is reversed at the reverse path 194, and is sent to the transport path 60 provided above the recording medium housing portion 48. Then, toner images are formed on the back surface in the above-described process.

In the image forming apparatus 10 according to this exemplary embodiment, parts for forming images of the first and second special colors (the image forming units 16V and 16W, the exposure devices 40V and 40W, the toner cartridges 14V and 14W, and the first transfer rollers 36V and 36W) are removably mounted as additional parts on the first housing 10A according to the selection of the user. Therefore, the image forming apparatus 10 may have a configuration without the parts for forming images of the first and second special colors, or a configuration with parts for forming an image of one of the first and second special colors.

First Transfer Unit of Transfer Device

Next, the first transfer unit 33 of the transfer device 32 is described.

Figure 3:
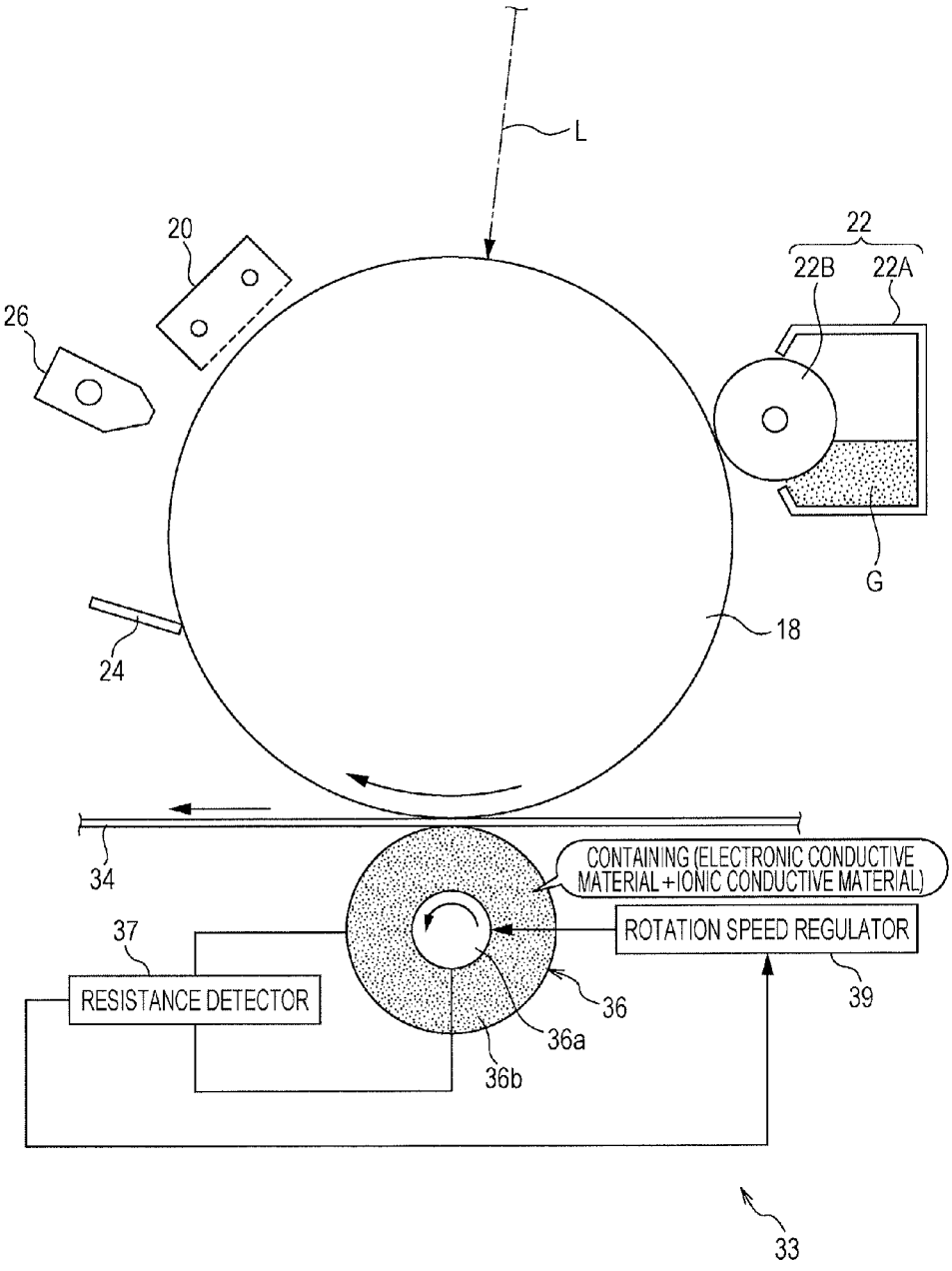
FIG. 3 illustrates a configuration of a first transfer unit of a transfer device in FIG. 1.

FIG. 3 illustrates a configuration of the first transfer unit 33 of the transfer device 32.

As shown in FIG. 3, the first transfer roller 36 of the first transfer unit 33 includes a core bar 36*a* formed of a metal material, such as aluminum or a steel material, and a cover layer 36*b* formed of a rubber material, such as nitrile rubber or epichlorohydrin. The core bar 36*a* is covered with the cover layer 36*b*. The cover layer 36*b* contains two types of conductive materials including an electronic conductive material (for example, carbon black) and an ionic conductive material (for example, ammonium salt), and hence is semiconductive.

The first transfer unit 33 is provided with a resistance detector 37 being an example of an electrical resistance detector, and a rotation speed regulator 39 being an example of a regulator. The resistance detector 37 is connected with the core bar 36*a* and the cover layer 36*b* of the first transfer roller 36, and detects the electrical resistance of the first transfer roller 36. The rotation speed regulator 39 regulates the rotation speed of the first transfer roller 36 in accordance with the electrical resistance detected by the resistance detector 37. The first transfer roller 36 contacts the transfer belt 34 that moves in synchronization with the rotational movement of the photoconductor drum 18. However, the rotation speed regulator 39 regulates the rotation speed of the first transfer roller 36 independently from the movement of the photoconductor drum 18 and the transfer belt 34.

Figure 4:
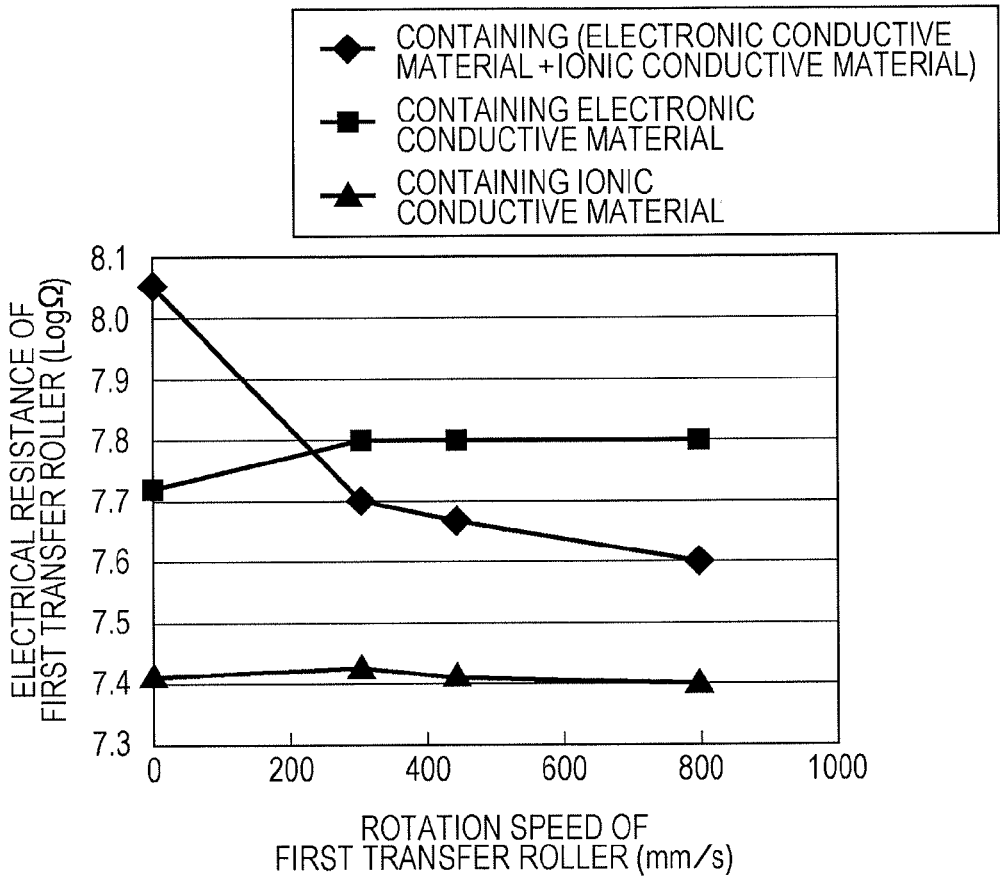
FIG. 4 is a graph showing the relationship between a rotation speed and an electrical resistance of a first transfer roller in FIG. 3.

FIG. 4 shows the relationship between the rotation speed and the electrical resistance of the first transfer roller 36.

As shown in FIG. 4, when the cover layer 36*b* contains only the electronic conductive material as the conductive material, and when the cover layer 36*b* contains only the ionic conductive material as the conductive material, the electrical resistance of the first transfer roller 36 is substantially constant regardless of the rotation speed. In contrast, when the cover layer 36*b* contains the two types of conductive materials including the electronic conductive material and the ionic conductive material, it is found that the electrical resistance of the first transfer roller 36 is changed in accordance with the rotation speed, i.e., the electrical resistance is changed to be decreased as the rotation speed is increased.

The electrical resistance of the first transfer roller 36 is changed in accordance with the rotation speed when the cover layer 36*b* contains the two types of conductive materials including the electronic conductive material and the ionic conductive material because the gaps between particles of the electronic conductive material adequately dispersed in the cover layer 36*b* function as capacitors and hence the electrical resistance exhibits a time response characteristic. If the cover layer 36*b* contains only the electronic conductive material as the conductive material, the content of the electronic conductive material becomes excessive, the electrical resistance does not exhibit the time response characteristic, and hence a phenomenon in which the electrical resistance is changed in accordance with the rotation speed does not occur. If the cover layer 36*b* contains only the ionic conductive material as the conductive material, since the electronic conductive material is not present, the electrical resistance does not exhibit the time response characteristic, and hence the phenomenon in which the electrical resistance is changed in accordance with the rotation speed does not occur.

Meanwhile, the electrical resistance of the first transfer roller 36 is changed depending the environment under which the first transfer roller 36 is exposed, and is also changed over the time of use of the first transfer roller 36. More specifically, the electrical resistance is decreased as the first transfer roller 36 is put under a high-temperature high-humidity environment, and the electrical resistance is increased as the first transfer roller 36 is put under a low-temperature low-humidity environment. Also, if transfer processing is performed for a long time, the electrical resistance of the first transfer roller 36 is gradually increased.

In the first transfer unit 33 of the transfer device 32, the cover layer 36*b* of the first transfer roller 36 contains the two types of conductive materials including the electronic conductive material and the ionic conductive material. Accordingly, the first transfer roller 36 obtains the characteristic that the electrical resistance is changed in accordance with the rotation speed, and the rotation speed of the first transfer roller 36 is regulated by the rotation speed regulator. In particular, even if the electrical resistance of the first transfer roller 36 is changed because the environment under which the first transfer roller 36 is exposed or because the first transfer roller 36 is used for a long time, the electrical resistance of the first transfer roller 36 is held constant by regulating the rotation speed of the first transfer roller 36.

More specifically, regarding the first transfer unit 33 of the transfer device 32, the rotation speed regulator 39 regulates the rotation speed of the first transfer roller 36 so that the electrical resistance detected by the resistance detector 37 becomes a predetermined value (for example, 7.5 Log Ω). That is, an optimum transfer voltage is constantly applied to the first transfer roller 36, and transfer current that flows from the first transfer roller 36 to the photoconductor drum 18 is constant.

Figure 5:
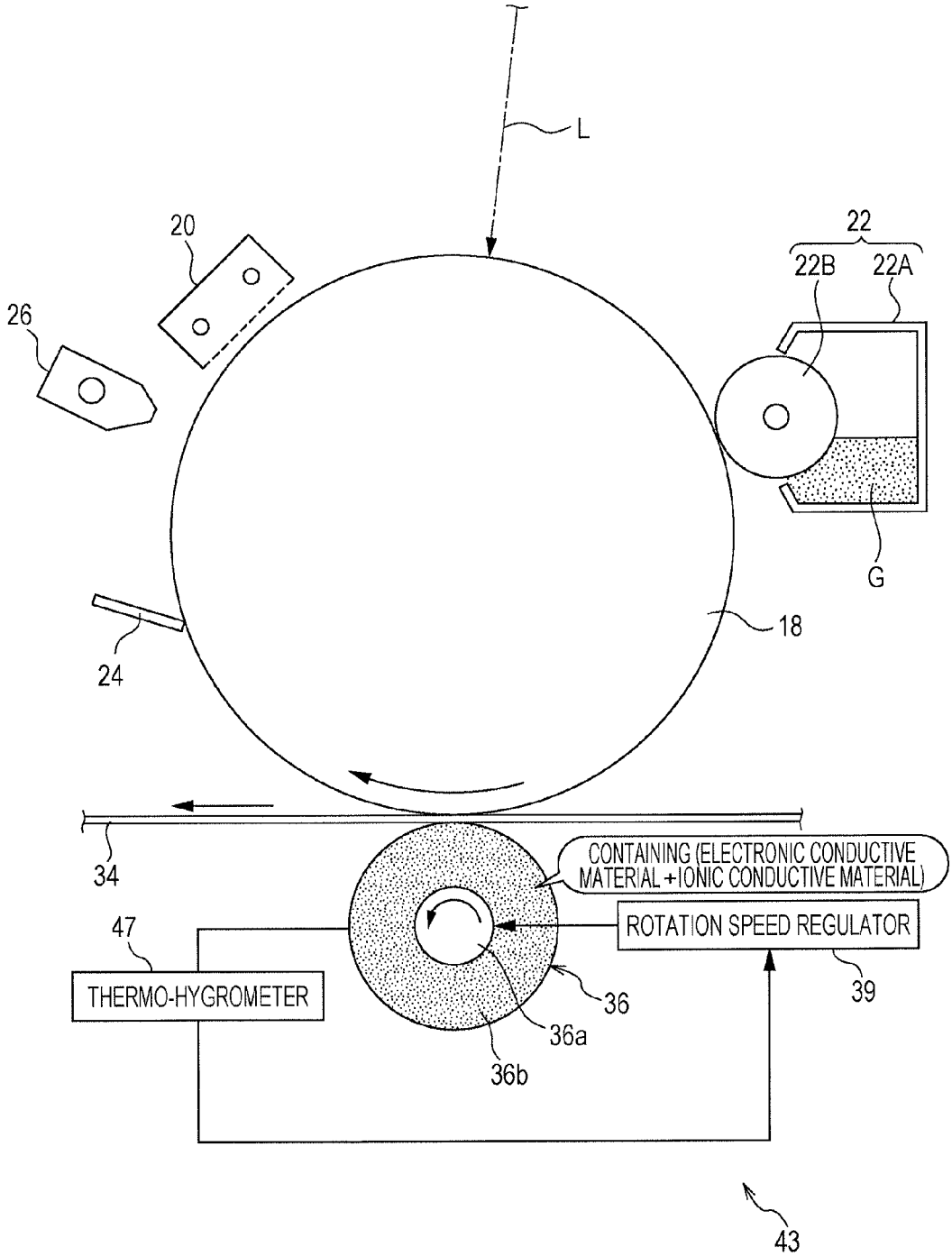
FIG. 5 illustrates a configuration of a first transfer unit that is a modification of the first transfer unit in FIG. 3.

FIG. 5 illustrates a configuration of a first transfer unit 43 according to a modification of the first transfer unit 33 of the transfer device 32.

As shown in FIG. 5, the first transfer unit 43 according to the modification is provided with a thermo-hydrometer 47 as an example of an environment detector instead of the resistance detector 37. The thermo-hydrometer 47 detects the temperature and humidity as the environment under which the first transfer roller 36 is exposed. Regarding the first transfer unit 43, the rotation speed regulator 39 regulates the rotation speed of the first transfer roller 36 in accordance with the temperature and humidity measured by the thermo-hydrometer 47. That is, since the rotation speed of the first transfer roller 36 is regulated in accordance with the temperature and humidity measured by the thermo-hydrometer 47, even if the environment under which the first transfer roller 36 is exposed is changed, the electrical resistance of the first transfer roller 36 is held constant.

More specifically, the rotation speed of the first transfer roller 36 is increased as the temperature and humidity measured by the thermo-hydrometer 47 become a low temperature and a low humidity, and the rotation speed of the first transfer roller 36 is decreased as the temperature and humidity measured by the thermo-hydrometer 47 become a high temperature and a high humidity, so that the electrical resistance of the first transfer roller 36 becomes the predetermined value (for example, 7.5 Log Ω).

Figure 6:
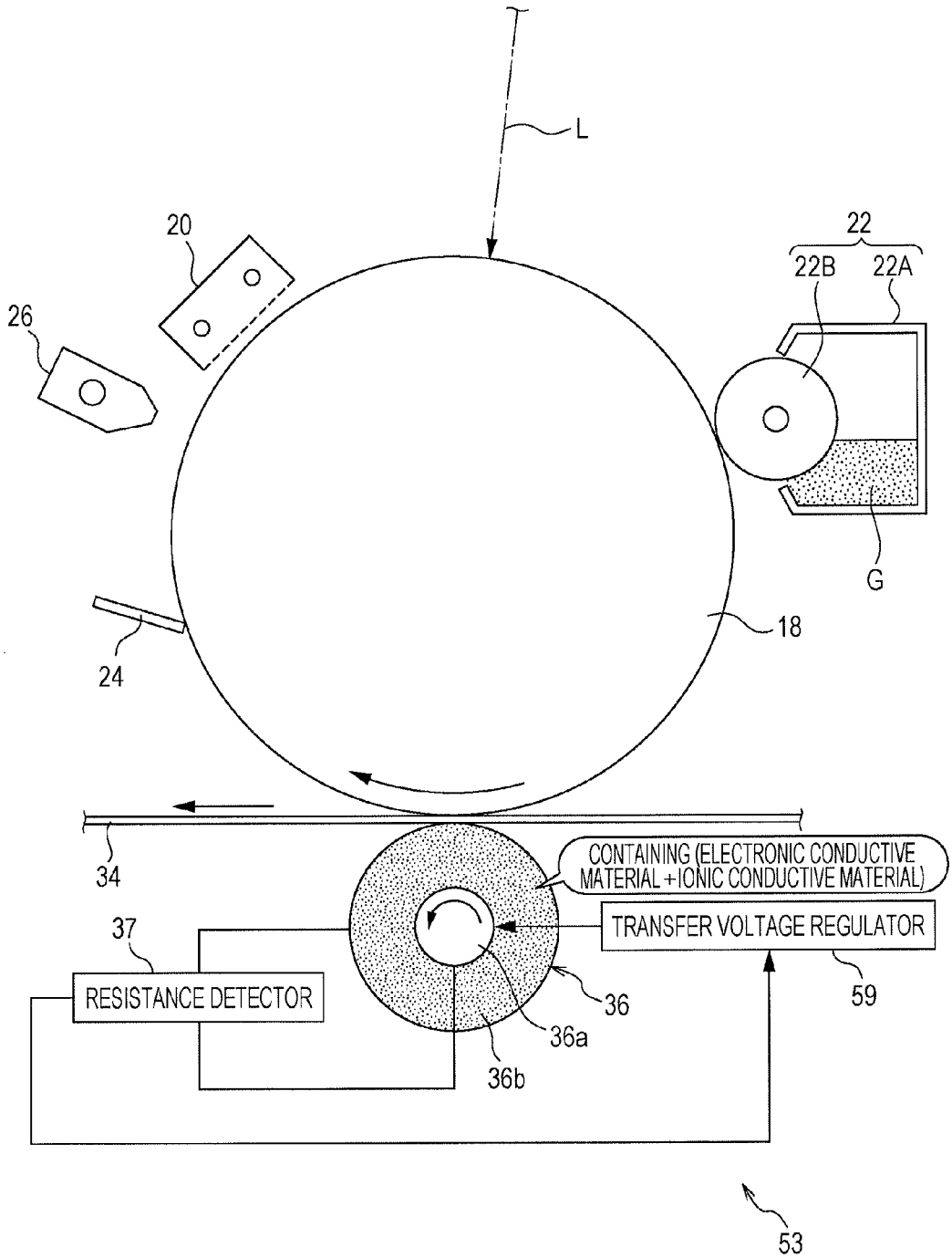
FIG. 6 illustrates a configuration of a first transfer unit that is a first comparative example of the first transfer unit in FIG. 3.

FIG. 6 illustrates a configuration of a first transfer unit 53 according to a first comparative example of the first transfer unit 33 of the transfer device 32.

As shown in FIG. 6, the first transfer unit 53 according to the first comparative example is provided with a transfer voltage regulator 59 that regulates a transfer voltage that is applied to the first transfer roller 36, instead of the rotation speed regulator 39. Regarding the first transfer unit 53, the transfer voltage that is applied to the first transfer roller 36 is regulated in accordance with the electrical resistance detected by the resistance detector 37.

More specifically, the transfer voltage regulator 59 regulates the transfer voltage to be increased as the electrical resistance detected by the resistance detector 37 is increased, and regulates the transfer voltage to be decreased as the electrical resistance detected by the resistance detector 37 is decreased, so that the transfer current that flows from the first transfer roller 36 to the photoconductor drum 18 becomes constant.

Figure 7:
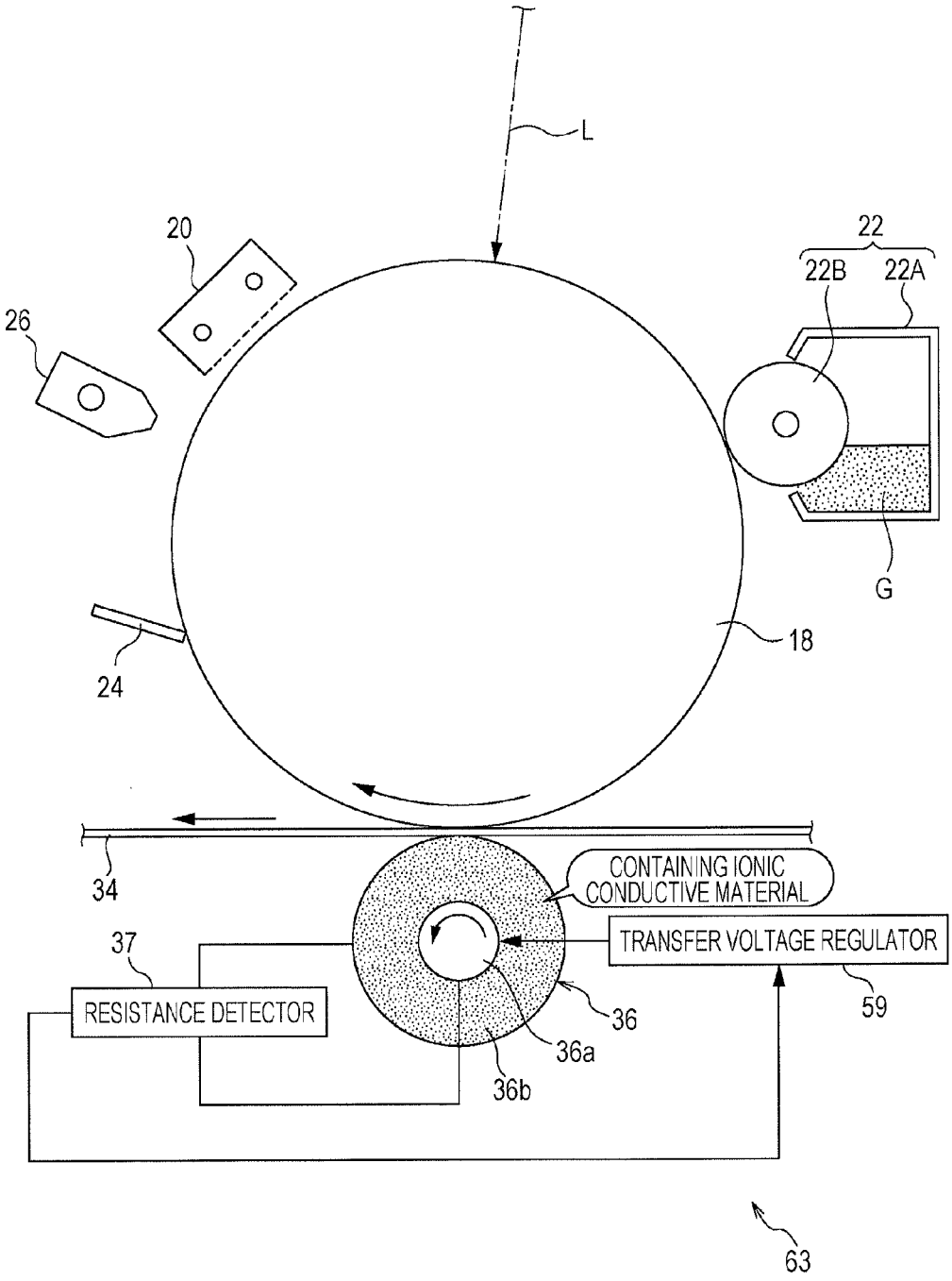
FIG. 7 illustrates a configuration of a first transfer unit that is a second comparative example of the first transfer unit in FIG. 3.

FIG. 7 illustrates a configuration of a first transfer unit 63 according to a second comparative example of the first transfer unit 33 of the transfer device 32.

As shown in FIG. 7, the first transfer unit 63 according to the second comparative example is provided with the transfer voltage regulator 59 like the transfer voltage regulator 59 of the first transfer unit 53 according to the first comparative example. Also, the first transfer roller 36 of the first transfer unit 63 according to the second comparative example has the cover layer 36*b* containing only the ionic conductive material as the conductive material.

FIG. 8 illustrates a table showing image qualities of images, and transfer voltages, rotation speeds, and electrical resistances of the first transfer rollers 36, when the transfer devices 32 respectively including the first transfer unit 33 according to the exemplary embodiment, the first transfer unit 43 according to the modification, the first transfer unit 53 according to the first comparative example, and the first transfer unit 63 according to the second comparative example, and when images are formed under a low-temperature low-humidity (LL) condition (for example, at the temperature of 10° C. with the humidity of 15%) and a high-temperature high-humidity (HH) condition (for example, at the temperature of 28° C. with the humidity of 85%).

An "early stage" in the table represents an early stage of image formation (for example, a stage, in which solid images are formed on 10 sheets of A4 paper). "After lapse of long time" represents a stage after image formation is performed for a long time (for example, a stage after solid images are formed on 800000 sheets of A4 paper). For the image quality, a A sign represents a highest level, a B sign represents a high level, a C sign represents an acceptable level, and a D sign represents an unacceptable level.

As shown in the table in FIG. 8, when the image formation is performed by using the transfer device 32 including the first transfer unit 33, the image quality in the early stage under the low-temperature low-humidity (LL) condition, the image quality in the early stage under the high-temperature high-humidity (HH) condition, the image quality after the lapse of a long time under the low-temperature low-humidity (LL) condition, and the image quality after the lapse of a long time under the high-temperature high-humidity (HH) condition each are the highest level. This is because the rotation speed regulator 39 regulates the rotation speed of the first transfer roller 36 so that the electrical resistance of the first transfer roller 36 detected by the resistance detector 37 becomes the optimal value (7.5 Log Ω), hence the electrical resistance of the first transfer roller 36 is held at the optimal value (7.5 Log Ω), and the optimal transfer voltage (2.5 kV) is applied to the first transfer roller 36.

As the transfer voltage that is applied to the first transfer roller 36 becomes higher than the optimal transfer voltage (2.5 kV), a transfer defect due to discharge or a transfer defect due to insufficiency of a transfer power source capacity more likely occurs, and as the result, the image quality becomes worse. On the other hand, as the transfer voltage that is applied to the first transfer roller 36 becomes lower than the optimal transfer voltage (2.5 kV), a transfer defect due to deterioration in graininess of a toner or a transfer defect due to insufficiency of bias more likely occurs, and as the result, the image quality becomes worse.

If image formation is performed by the transfer device 32 including the first transfer unit 43 according to the modification, the image quality in the early stage under the low-temperature low-humidity (LL) condition, the image quality in the early stage under the high-temperature high-humidity (HH) condition, and the image quality after the lapse of a long time under the high-temperature high-humidity (HH) condition each are the highest level. This is because the rotation speed regulator 39 regulates the rotation speed of the first transfer roller 36 in accordance with the temperature and humidity measured by the thermo-hydrometer 47, hence the electrical resistance of the first transfer roller 36 is held at the optimal value (7.5 Log Ω), and the optimal transfer voltage (2.5 kV) is applied to the first transfer roller 36. The image quality after the lapse of a long time under the low-temperature low-humidity (LL) condition is the high level. This is because the electrical resistance of the first transfer roller 36 becomes slightly higher than the optimal value (7.5 Log Ω) over the use for a long time, and a transfer voltage that is slightly higher than the optimal transfer voltage (2.5 kV) is applied to the first transfer roller 36 by the constant current control.

If image formation is performed by the transfer device 32 including the first transfer unit 53 according to the first comparative example, the image quality in the early stage under the low-temperature low-humidity (LL) condition is the high level, the image quality in the early stage under the high-temperature high-humidity (HH) condition and the image quality after the lapse of a long time under the high-temperature high-humidity (HH) condition each are the acceptable level, and the image quality after the lapse of a long time under the low-temperature low-humidity (LL) condition is the unacceptable level.

If image formation is performed by the transfer device 32 including the first transfer unit 63 according to the second comparative example, the image quality in the early stage under the low-temperature low-humidity (LL) condition is the high level, and the image quality in the early stage under the high-temperature high-humidity (HH) condition, the image quality after the lapse of a long time under the low-temperature low-humidity (LL) condition, and the image quality after the lapse of a long time under the high-temperature high-humidity (HH) condition each are the unacceptable level.

The first transfer unit 53 according to the first comparative example and the first transfer unit 63 according to the second comparative example each have the configuration in which the transfer voltage that is applied to the first transfer roller 36 is regulated in accordance with the electrical resistance of the first transfer roller 36 detected by the resistance detector 37. Hence, if the electrical resistance of the first transfer roller 36 is changed because the temperature and humidity to which the first transfer roller 36 is exposed are changed or because the first transfer roller 36 is used for a long time, the transfer voltage that is applied to the first transfer roller 36 is markedly changed from the optimal transfer voltage (2.5 kV). Owing to this, if image formation is performed with the transfer device 32 including the first transfer unit 53 according to the first comparative example or the first transfer unit 63 according to the second comparative example, the image quality generally becomes worse than the image quality if image formation is performed with the transfer device 32 including the first transfer unit 33 according to the exemplary embodiment or the first transfer unit 43 according to the modification. Regarding the first transfer unit 53 according to the first comparative example and the first transfer unit 63 according to the second comparative example, the rotation speed of the first transfer roller 36 is fixed to a speed (0.4 m/s) that is synchronized with the moving speed of the photoconductor drum 18 and the transfer belt 34.

As described above, the transfer device 32 including the first transfer unit 33 according to the exemplary embodiment or the first transfer unit 43 according to the modification includes the first transfer roller 36 that has a characteristic in which the electrical resistance is changed in accordance with the rotation speed, contacts the transfer belt 34 that moves in synchronization with the movement of the photoconductor drum 18 holding a toner image, and transfers the toner image held by the photoconductor drum 18 on the transfer belt 34 by applying the transfer voltage to the transfer belt 34; and the rotation speed regulator 39 that regulates the rotation speed of the first transfer roller 36 independently from the movement of the photoconductor drum 18 and the transfer belt 34. In other words, in the transfer device 32 including the first transfer unit 33 according to the exemplary embodiment or the first transfer unit 43 according to the modification, the first transfer roller 36 has the characteristic in which the electrical resistance is changed in accordance with the rotation speed, and the rotation speed regulator 39 that regulates the rotation speed of the first transfer roller 36 is provided. Accordingly, even if the electrical resistance of the first transfer roller 36 is changed because the environment (the temperature and humidity) under which the first transfer roller 36 is exposed or because the first transfer roller 36 is used for a long time, the electrical resistance of the first transfer roller 36 is held constant by regulating the rotation speed of the first transfer roller 36. Also, since the rotation speed of the first transfer roller 36 is regulated independently from the movement of the photoconductor drum 18 and the transfer belt 34, the electrical resistance of the first transfer roller 36 may be regulated without changing the transfer speed (print speed).

Also, in the transfer device 32 including the first transfer unit 33 according to the exemplary embodiment or the first transfer unit 43 according to the modification, the rotation speed of the first transfer roller 36 is regulated so that the electrical resistance of the first transfer roller 36 becomes a predetermined value (for example, 7.5 Log Ω). Accordingly, a good image is formed as compared with a case in which the transfer voltage is regulated in the manner of the transfer device 32 including the first transfer unit 53 according to the first comparative example or the first transfer unit 63 according to the second comparative example.

Also, the transfer device 32 including the first transfer unit 33 includes the resistance detector 37 that detects the electrical resistance of the first transfer roller 36, and the rotation speed of the first transfer roller 36 is regulated in accordance with the electrical resistance detected by the resistance detector 37. Accordingly, the rotation speed of the first transfer roller 36 may be easily regulated with a simple configuration such that the electrical resistance of the first transfer roller 36 becomes the predetermined value (for example, 7.5 Log Ω).

Also, the transfer device 32 including the first transfer unit 43 according to the modification includes the thermo-hydrometer 47 that detects the temperature and humidity to which the first transfer roller 36 is exposed, and the rotation speed of the first transfer roller 36 is regulated in accordance with the temperature and humidity measured by the thermo-hydrometer 47. Accordingly, the rotation speed of the first transfer roller 36 is easily regulated with a simple configuration such that the electrical resistance of the first transfer roller 36 becomes the predetermined value (for example, 7.5 Log Ω).

Also, the image forming apparatus 10 includes the photoconductor drum 18, an electrostatic latent image being formed on the photoconductor drum 18; the developing device 22 that develops the electrostatic latent image formed on the photoconductor drum 18 with a toner; and the transfer device 32 including the first transfer unit 33 according to the exemplary embodiment or the first transfer unit 43 according to the modification, the transfer device 32 transferring the toner image developed by the developing device 22 on the transfer belt 34. Accordingly, even if the environment under which the image forming apparatus 10 is exposed is changed, or even if the image forming apparatus 10 is used for a long time, an image with good image quality is formed on a recording medium P.

In the above description, the first transfer roller 36 of the transfer device 32 has the characteristic in which the electrical resistance is changed in accordance with the rotation speed, and the rotation speed regulator 39 regulates the rotation speed of the first transfer roller 36. Alternatively, the second transfer roller 62 may have the characteristic in which the electrical resistance is changed in accordance with the rotation speed, and the rotation speed regulator 39 may regulate the rotation speed of the second transfer roller 62.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transfer device, comprising:

a transfer roller that has a characteristic in which an electrical resistance is decreased with an increase in a rotation speed of the transfer roller, contacts a transferred body that moves in synchronization with movement of an image holding body holding a toner image, and transfers the toner image held by the image holding body onto the transferred body by applying a transfer voltage to the transferred body; and a regulator that regulates the rotation speed of the transfer roller independently from the movement of the image holding body and the transferred body.

2. The transfer device according to claim 1, wherein the regulator regulates the rotation speed of the transfer roller so that the electrical resistance of the transfer roller becomes a predetermined value.

3. The transfer device according to claim 1, further comprising:

an electrical resistance detector that detects the electrical resistance of the transfer roller, wherein the regulator regulates the rotation speed of the transfer roller in accordance with the electrical resistance detected by the electrical resistance detector.

4. The transfer device according to claim 1, further comprising:

an environment detector that detects an environment under which the transfer roller is exposed, wherein the regulator regulates the rotation speed of the transfer roller in accordance with the environment detected by the environment detector.

5. An image forming apparatus, comprising:

an image holding body, an electrostatic latent image being formed on the image holding body;

a developing device that develops the electrostatic latent image formed on the image holding body with a toner; and the transfer device according to claim 1, the transfer device transferring the toner image developed by the developing device onto the transferred body.

6. The transfer device according to claim 1, wherein a cover layer of the transfer roller contains an electronic conductive material and an ionic conductive material.

* * * * *